US005723195A

United States Patent [19]

Pacione

[11] Patent Number: 5,723,195

[45] Date of Patent: Mar. 3, 1998

[54] CARPET AND UNDERPAD ATTACHMENT SYSTEM

[76] Inventor: Joseph Rocco Pacione, 127 Elgin Street, Thornhill, Ontario L3T 1W7, Canada

[21] Appl. No.: 124,223

[22] Filed: Sep. 21, 1993

[51] Int. Cl.[6] ..... B32B 9/00

[52] U.S. Cl. ..... 428/100; 428/40.1; 428/52; 428/62; 428/85; 428/88; 428/95; 428/97; 428/99; 428/192; 428/223; 428/286; 156/71; 156/72; 156/293; 156/298; 156/304.4

[58] Field of Search ..... 428/86, 100, 223, 428/88, 95, 40.1, 47, 62, 85, 94, 97, 99, 192, 286, 317.1, 52; 156/71, 72, 304.7, 293, 298, 304.4

[56] References Cited

U.S. PATENT DOCUMENTS

| | | | |
|---|---|---|---|
| 2,021,929 | 8/1935 | Knowland . | |
| 3,353,663 | 11/1967 | Kayser et al. . | |
| 3,484,316 | 12/1969 | Dirrim . | |
| 3,550,223 | 12/1970 | Erb . | |
| 3,583,057 | 6/1971 | Kolozsvary . | |
| 3,600,261 | 8/1971 | Kerres . | |
| 3,660,191 | 5/1972 | Shimota et al. | 156/152 |
| 3,711,349 | 1/1973 | Snyder et al. . | |
| 3,817,015 | 6/1974 | Frangos . | |
| 3,866,267 | 2/1975 | Poletti . | |
| 4,012,544 | 3/1977 | Richards . | |
| 4,336,289 | 6/1982 | Davis . | |
| 4,350,721 | 9/1982 | Nagase . | |
| 4,361,610 | 11/1982 | Roth . | |
| 4,405,668 | 9/1983 | Wald . | |
| 4,557,774 | 12/1985 | Hoopengardner | 156/71 |
| 4,581,269 | 4/1986 | Tilman . | |
| 4,581,274 | 4/1986 | Johns et al. . | |
| 4,671,976 | 6/1987 | Vidal . | |
| 4,716,065 | 12/1987 | McLaughlin . | |
| 4,730,432 | 3/1988 | Schäfer et al. . | |
| 4,755,401 | 7/1988 | Friedrich et al. . | |
| 4,769,895 | 9/1988 | Parkins . | |
| 4,810,546 | 3/1989 | McLaughlin . | |
| 4,822,658 | 4/1989 | Pacione | 428/95 |
| 4,824,498 | 4/1989 | Goodwin et al. . | |
| 4,974,384 | 12/1990 | Pacione . | |
| 5,191,692 | 3/1993 | Pacione . | |
| 5,214,942 | 6/1993 | Peake, III et al. | 66/194 |

FOREIGN PATENT DOCUMENTS

| | | |
|---|---|---|
| 0062738 | 10/1982 | European Pat. Off. . |
| 0529575 | 3/1993 | European Pat. Off. . |
| 7029524 | 11/1970 | Germany . |
| 2201231 | 7/1973 | Germany . |
| 2803006 | 8/1979 | Germany . |
| 1204886 | 9/1970 | United Kingdom . |
| 1376262 | 12/1974 | United Kingdom . |
| 1546901 | 3/1979 | United Kingdom . |
| 2083352 | 3/1982 | United Kingdom . |
| 2188080 | 9/1987 | United Kingdom . |
| 86/03164 | 6/1986 | WIPO . |

OTHER PUBLICATIONS

Popular Science Magazine, p. 113, Aug., 1964.
Mad Magazine, p. 40, May 1984.

*Primary Examiner*—Patrick Ryan
*Assistant Examiner*—Abraham Bahta
*Attorney, Agent, or Firm*—Brian W. Gray; John C. Hunt

[57] ABSTRACT

This invention relates to a method of installing wall to wall carpeting of a selected width over an underpad of a selected thickness by attaching hooked tapes of a thickness substantially equal to the thickness of the underpad along the perimeter of the area to be covered by the carpeting. The underside of the carpeting, which is substantially covered with loops, is then attached to the upper surface of the tapes through hook and loop technology. The hooked tape and the underpad are of substantially equal thickness so that the loops on the underside of the carpet will attach to the hooks on the upper surface of the tape. In a further aspect, the underpad has loops substantially covering its lower surface so that the underpad is attached to the floor by a second hooked tape of lower profile than the carpet tape which is used to attach the underpad to the floor.

3 Claims, 4 Drawing Sheets

CARPET AND UNDERPAD ATTACHMENT SYSTEM

FIELD OF THE INVENTION

This invention relates to carpets and carpet installations, particularly wall to wall carpets, using a hook and loop installation system as disclosed in U.S. Pat. No. 4,822,658.

BACKGROUND OF THE INVENTION

U.S. Pat. No. 4,822,658, of the same inventor, presents a completely new way of installing carpeting, particularly wall to wall carpeting, using a carpet whose undersurface is substantially covered with loops or loopy material to be installed by the use of complementary hooked tapes. The disclosure of this patent is hereby incorporated by reference.

It was the primary intention of this system to attach the carpet directly to the floor without a separate underpad. However it may be desirable, in some instances, to use this system with a separate underpad.

Installing the underpad separately from the carpet allows for a choice of different underpads, having different thicknesses, or different cushioning or resiliency properties. Certain underpads can be very expensive and it may be cost effective in a location where it is desired to change the carpet more frequently (such as in rooms in hotels) to install the carpet over a separate underpad so that such underpad can remain in place when the carpet is removed and replaced.

In addition, because the carpet and underpad may be made of different materials, it may be desirable to separate the carpet from the underpad in situations where it is desired to recycle or reuse portions of either the carpet or the underpad. Typically the carpet may be made of a single substance, such as nylon, and the underpad made of a single additional substance such as urethane, in which case it may be desirable to be able to separate these two items for the purposes of recycling. This is particularly the case with carpet attached by the system disclosed in U.S. Pat. No. 4,822,658, since the carpet can be readily removed and replaced after installation.

In general a separate underpad installation is a harder system to install than the installation as shown in U.S. Pat. No. 4,822,658, but for the reasons already mentioned, it may be desirable in some situations.

One early attempt at using a hook and loop system with an underpad involved conventionally gluing such underpad to the floor and then attaching the carpet to the underpad with some form of hook and loop (United Kingdom Patent No. 1,546,901).

Apparently undisclosed in the art is a structure whereby, when the carpet is attached directly to the floor by hook and loop means, the profile of the hook tape is increased in height so as to accommodate the height of an interposed pad.

Also undisclosed is any means to attach and seam an underpad except by conventional gluing, stapling or double or single sided adhesive tape.

SUMMARY OF THE INVENTION

The present invention is designed to facilitate the use of the hook and loop system disclosed in U.S. Pat. No. 4,822,658 in connection with a separate underpad.

In one aspect of the invention, a carpet and pad assembly is provided in which the carpet has loop means substantially covering the underside of the carpet, and a matching tape is provided having hook means on its upper surface. The tape is attached to the floor so as to be affixed to the edges of an overlaid carpet, and if necessary, so as to attach edges of adjoining abutting carpet pieces. The tape is of a profile or thickness substantially to match the profile or thickness of the desired underpad, so that a desired underpad can be cut and fit within the area bounded by the carpet attaching tape without loss of the capability to attach the carpet directly to the floor as provided by the hook and loop attachment system disclosed in U.S. Pat. No. 4,822,658.

For this purpose, the body of the tape is increased in thickness to a thickness which is substantially equal to that of the underpad so that the hook means of tape project sufficiently near the surface of the underpad so that the loop means on the underside of the carpet will attach to the hook means on the tape.

In a further aspect, the invention allows the carpet pad itself to be attached by a hook and loop system, whereby the carpet underpad has at least one surface covered with loop means, and a second tape of lower profile than the carpet tape is used to attach the carpet pad to the floor.

In another aspect of the invention, pieces of the carpet pad itself can be attached together by use of hooked tape, whether or not the carpet pad itself is attached to the floor by hook and loop means.

There is thus provided, in yet another aspect of the invention, a carpet and pad assembly comprising carpet pieces having loop means substantially covering the underside of the carpet pieces, a tape having hook means on the tape upper surface, such hook means being complementary and attachable to the loop means of the carpet, and means on the tape underside for attachment of the tape to the floor, the tape laid in a pattern on the floor to attach the edges of the carpet pieces to the floor, and underpad pieces sized to fit within the area circumscribed by the tape and of a thickness substantially equal to the thickness of the tape. Removable covering means on the hook means of the tape prevent attachment of the carpet to the tape until the covering is removed. Separate means are provided for attachment of the underpad to the floor either by way of hook tape or conventional means.

In yet another aspect, the invention comprises a tape for attaching carpet having a looped backing to a floor with a selected thick underpad comprising a tape substantially covered in hook means on an exposed upper surface for removable attachment to an overlaid loop back carpet. A second lower surface of the tape has means for attachment of the tape to a floor. A resilient backing is interposed between the upper and lower surfaces of the tape, the backing having a thickness substantially equal to the thickness of the selected underpad. The backing is attached to the upper surface of tape with a peel strength greater than the peel strength of the bond formed between the hook means of the tape and a corresponding overlaid loop back carpet.

BRIEF DESCRIPTION OF THE DRAWINGS

Embodiments of the invention will now be described by way of example with reference to the drawings, in which.

PREFERRED EMBODIMENT

Figure 1:
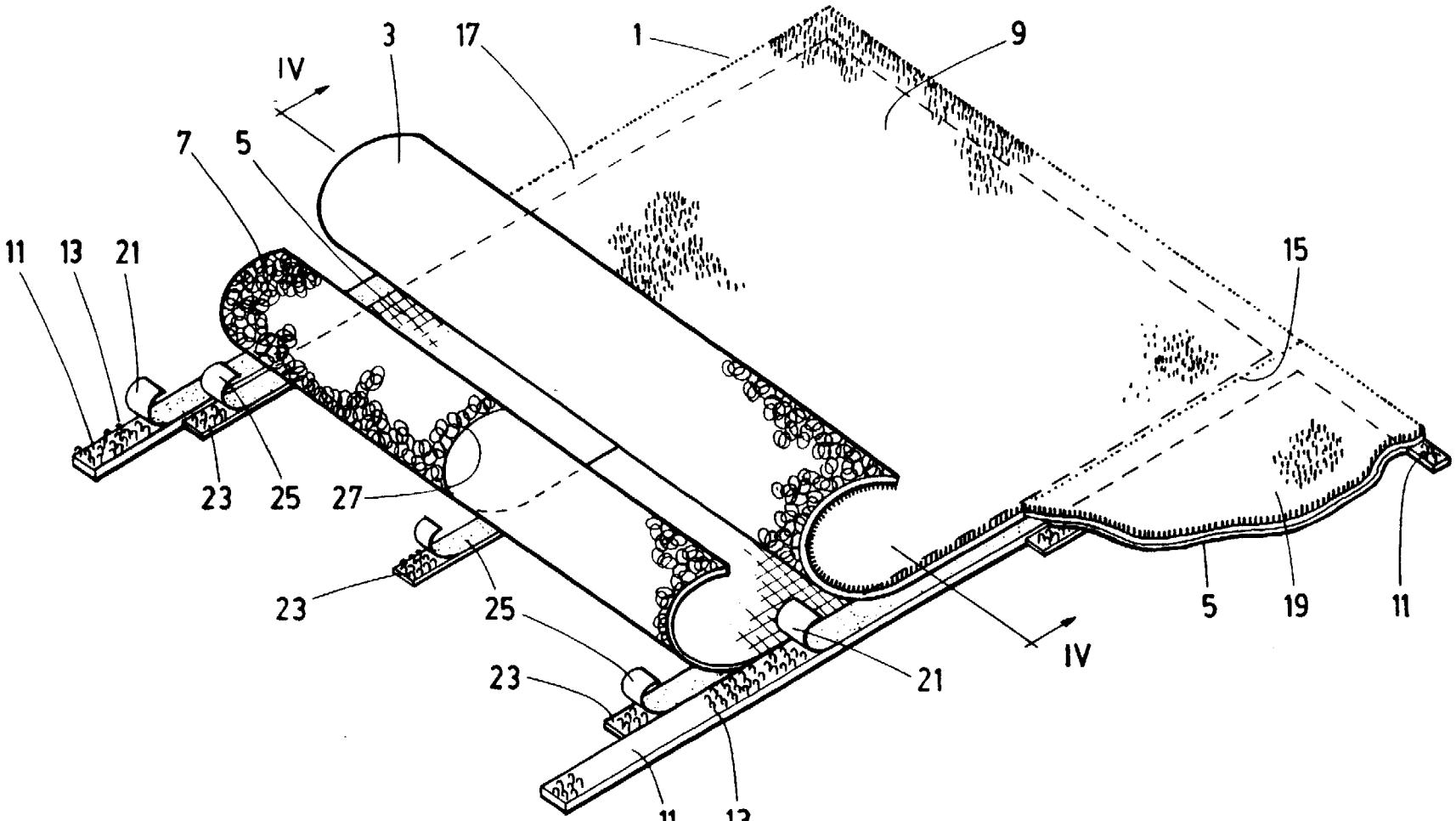
FIG. 1 is a perspective view of a preferred aspect of the invention in which both the carpet and pad are installed by a hook and loop attachment system.

As shown in FIG. 1, in a preferred embodiment, a carpet 1 having loops 3 along its underside is to be attached to the floor with a separate underpad 5. Of course, by loops are meant any form of loopy material such as is normally attachable to a complementary hook material in a Velcro type system. The hooks also may be actual barb shape or mushroom shaped hooks or other forms of upstanding hook-like filaments. Pad 5 also contains on its undersurface loops 7.

The upper surface of the pad may also be covered with loops as will be explained later in the embodiment shown in FIG. 3. The carpet contains decorative pile on its upper surface 9.

Tape 11 containing complementary hooks 13 is attached to the floor typically along the edges of the carpet or at any carpet join or seam 15. Of course in wall to wall installation the edges of some carpet pieces will be along the wall. When the tape is placed along a wall, the tape is entirely under the carpet edge, for instance at 17. Where the tape is placed at a seam such as 15, it normally runs under the edge of a carpet piece and the edge of an adjoining carpet piece (such as 19 in FIG. 1). A tape covering 21 is provided which is retained on the tape until the carpet has been fitted to the location. The tape covering will be removed as described later.

The carpet underpad, in the preferred embodiment, has its own tape 23 and its own tape covering 25, and again this tape may be attached at the edges of the underpad and also to connect adjoining pieces such as under seam 27.

Figure 4:
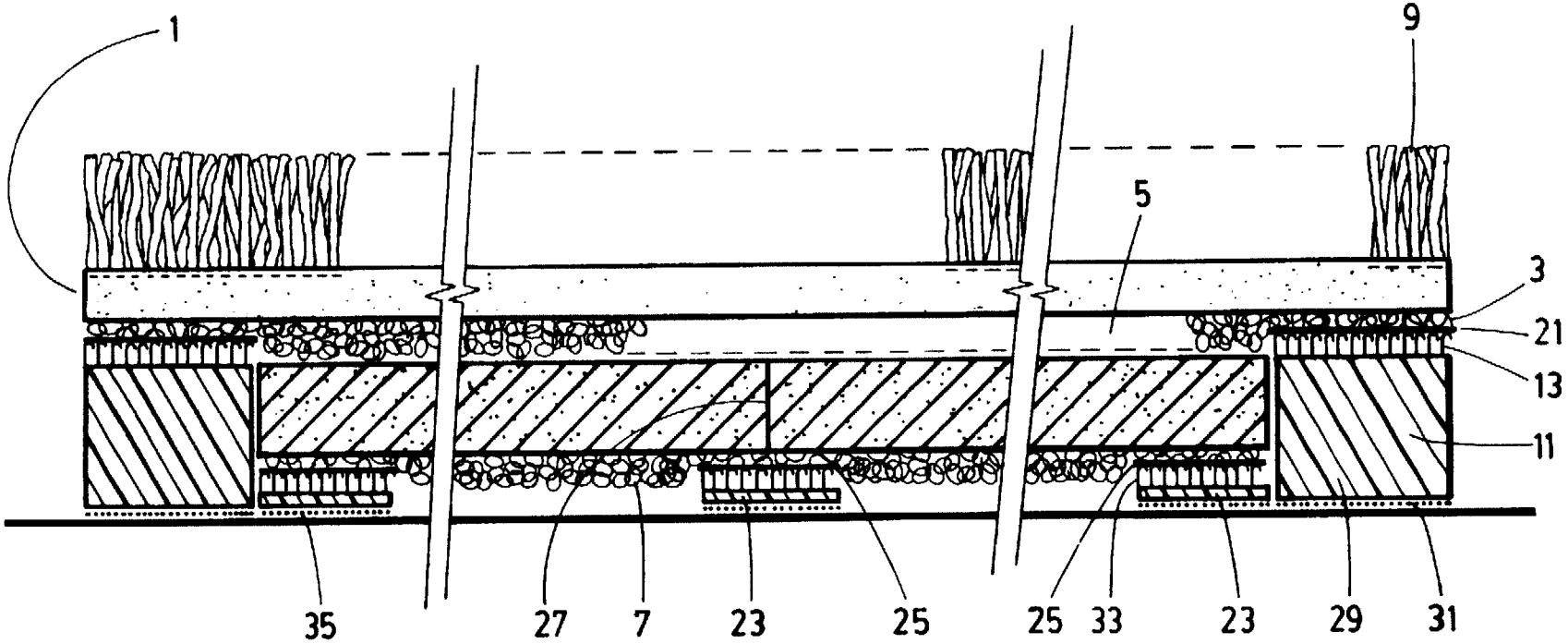
FIG. 4 shows a section through lines IV—IV of FIG. 1 and shows a cross-section of tape 11.

As shown in FIG. 4, tape 11 has a tape body 29 from which hooks 13 project. The tape body is normally a backing of urethane foam or any other suitable material such as latex or rubber which could add thickness, and preferably resiliency, to the tape. The tape 11 could be made by foaming latex or urethane directly in situ onto the surface of a scrim or other support for the hooks. The backing 29 may also be adhesively bonded or flame laminated in place. The backing 29 has on its undersurface a pressure sensitive adhesive 31.

The tape is normally flexible so that it can be rolled out on to a floor and adjust to variations in the floor or other substrate. However rigid or semi-rigid tape, although not preferred, could be used.

The backing 9 of tape 11 should have a peel or tear strength greater than the peel or tear strength of the bond formed between hooks 13 and carpet loops 3 or otherwise backing 11 could be pulled apart when carpet loops 3 are pulled from hooks 13 to replace or reposition carpet 1. Preferably also the bond between backing 11 and the floor will also be stronger than the bond between loops 3 and hooks 13. Generally, higher density, closed cell foams are preferred to provide such strength.

The pad 5 has on its undersurface loops 7 and its own separate tape 23 having hooks 33 and hook covering 25. The underpad tape 23 is normally of a profile as thin as possible, although in practice telegraphing of the tape through both the underpad and carpet would be unlikely. The thickness of the tape backing 11 is made substantially equal to the thickness of the underpad 5 with its loop covering 7 and the tape 23. However since tape 23 is of such low profile, in practice the tape backing 11 is also substantially equal simply to the thickness of the underpad 5.

While referring to tape "backing 29", it will be appreciated that the backing can either be integral with the hooks or a separate piece added to the hook layer. It need not be a distinguishable separate layer. The hooks may either be extruded or moulded plastic or projecting from a knitted or woven material.

It will be appreciated that in FIG. 4, tape coverings 25 and 21 are still in place, such coverings not having been removed to attach the loop means on the underside of the carpet or underpad to the hook means on the tape. When the covering is removed, the hook means will embed themselves generally into the loop means so that the height or space taken up by the combined loop and hook means is generally not significantly greater than the space taken up by the loop means of the carpet or underpad itself. Thus in FIG. 4, the spaces below carpet 1 and pad 27 are exaggerated.

It will also be appreciated that the other dimensions in FIG. 4 are not to scale and for the purpose of illustration only. Tape 23 is substantially thinner than pad 27 or carpet 1 and is shown exaggerated in FIG. 4. The height of this tape when hooks 33 are embedded in loops 27 is not normally a significant factor.

In practice, carpet often comes in six, nine or twelve foot widths. Therefore the tape will be aligned along the floor and attached preferably by pressure sensitive adhesive to the floor along the walls of the room and at the anticipated joins of the carpet. Preferably the tape has a sufficient width to adjust for any variations or irregularities in the joins caused by the fact that no carpet piece is truly accurately a rectangular size, especially over a long run. The tape 11 retains tape covering 21 on its surface so that carpet 1 can be adjusted to the location in which it will ultimately be attached.

Preferably before carpet 1 is placed on to tape 11, with its covering, an additional, lower profile tape 23 is attached to the floor, also by pressure sensitive adhesive 35. This tape also retains its tape covering 25. Initially such tape will be placed alongside the higher profile tape 11. Such higher profile tape is essentially an edge against which the underpad 5 will preferably abut. Similarly, since underpads generally come in standard widths, additional tape 23 will be placed at any anticipated seam, such as 27.

At this point, the underpad tape covering 25 can be removed and the underpad installed in the space bounded by the carpet tape 11 and in any adjoining spaces created by the grid work of similar carpet tapes 11 placed upon the floor as required.

Carpet 1 is then rolled in place and when properly adjusted, tape covering 21 is removed to affix the carpet to the floor.

In the preferred embodiment shown in FIG. 1, the underpad has been modified so that at least one surface is covered by a loopy material so that it can be attached to the floor by a hook and loop system. It is also possible to attach a conventional underpad to the floor in conventional ways using the higher profile tape of this invention. Such a situation is shown in FIG. 2 where in fact a conventional underpad 37 could be used between carpet retaining tape 39.

It may be possible in some situations to allow the pad to "free float" as the pad will be circumscribed between the area bounded by the tape 11 which is used to attach the carpet to the floor. In most situations, however, the pad should be attached to the floor so as not to move during usage.

Figure 3:
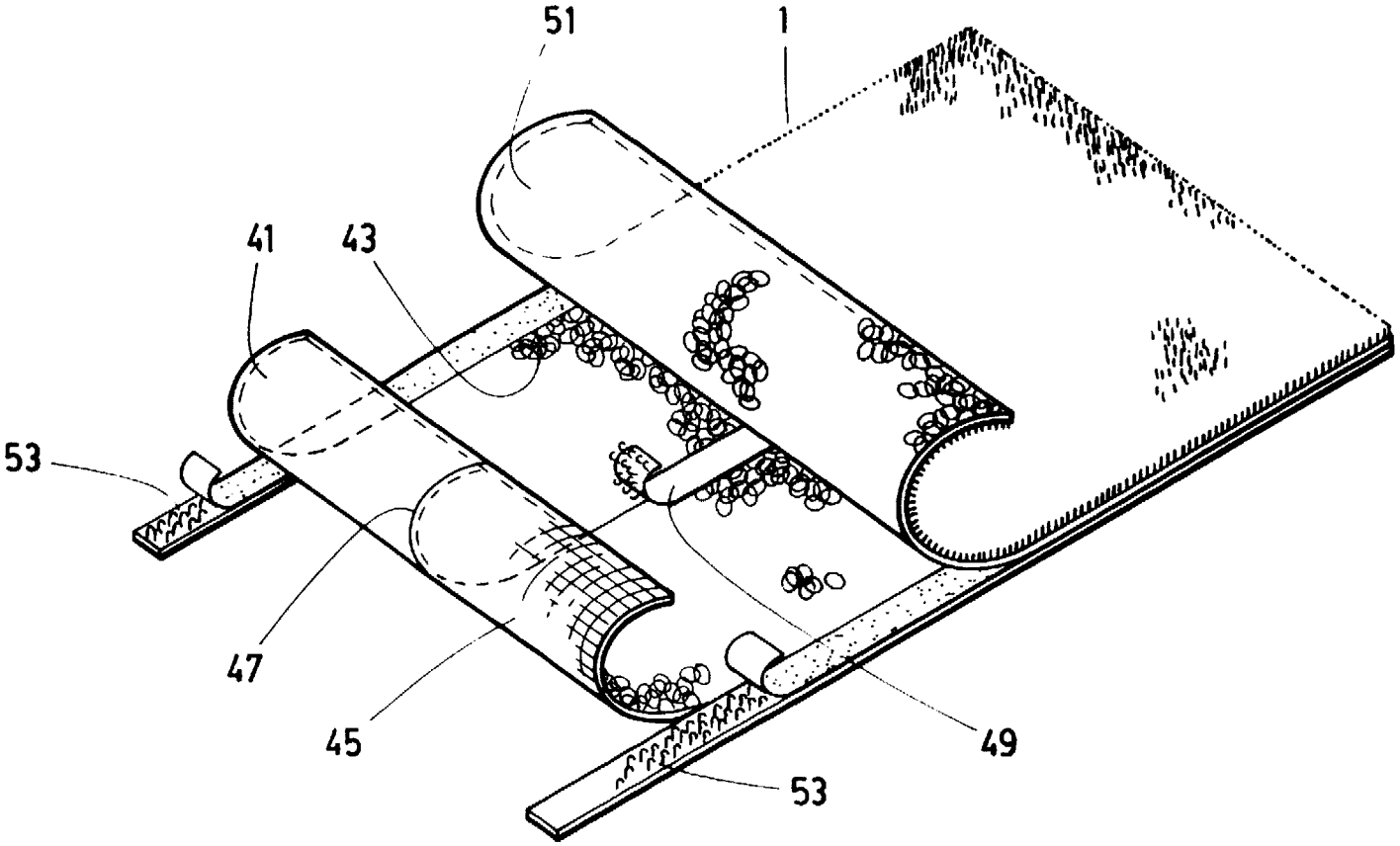
FIG. 3 is yet another embodiment in which the pad has a loop surface which is placed upright so that pad pieces can be attached together by a hook tape.

An alternative embodiment is shown in FIG. 3 in which pad 41 has a loop covering 43 on its upper surface. This type of pad allows for the attachment of an abutting piece 45 along seam 47 by the use of hooked tape 49. This tape will preferably be of a light weight and relatively low profile so as to minimize any possibility of telegraphing the tape to the surface of the carpet 51.

Figure 2:
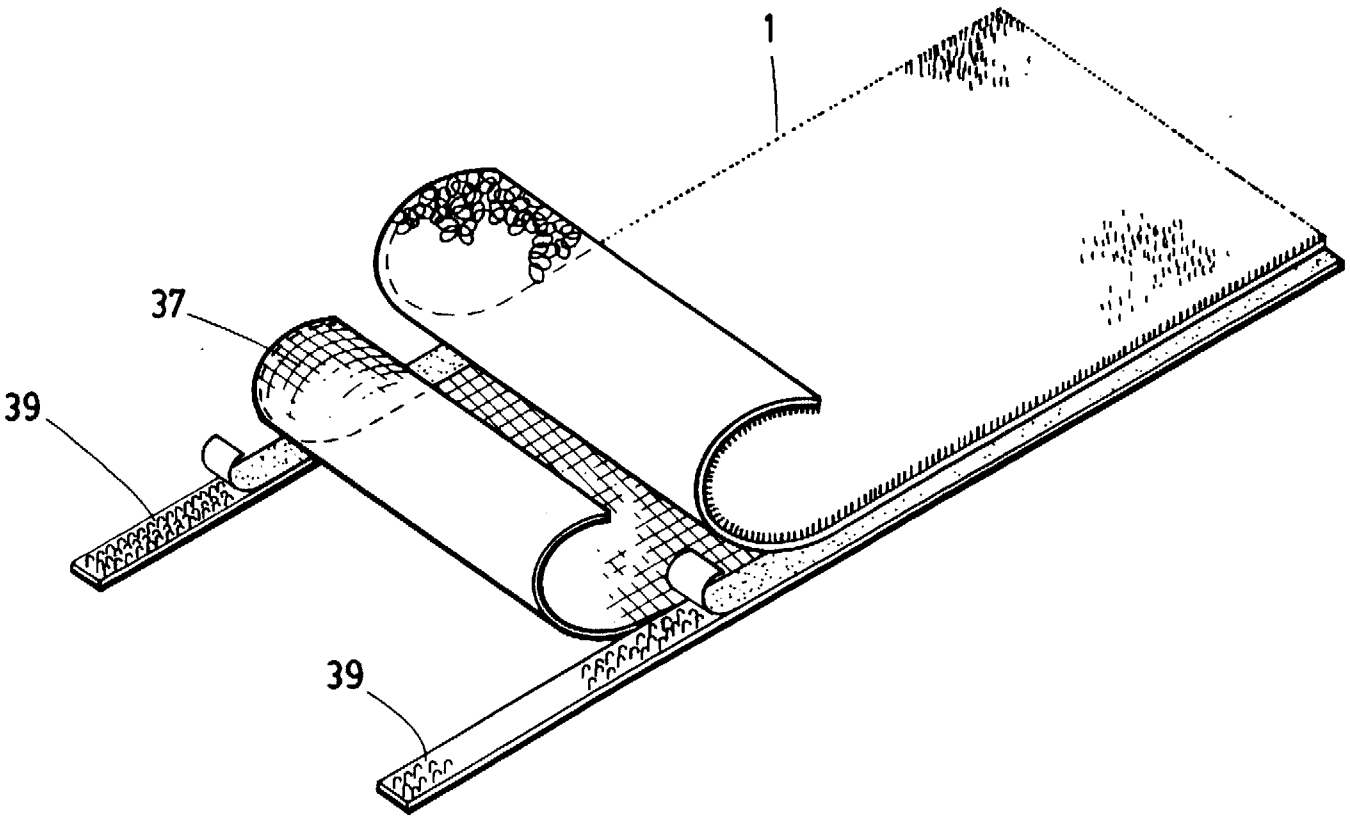
FIG. 2 is an alternative embodiment in which a conventional pad is used between the new carpet tape of this invention.

In the embodiment shown in FIG. 2, the carpet can also be of two pieces and attached together by conventional adhesive tape or other conventional means.

Further, the embodiment shown in FIG. 3, can also be used with the embodiment shown in FIG. 1 with a carpet underpad which has loops covering both its upper and lower surface. In this case, the seaming could be done from on top of the underpad so that tape 23 essentially will be inverted and used on top of the underpad.

While certain preferred embodiments have been disclosed various modifications to these might be made without departure from the spirit of the invention. The preferred embodiments are not intended to limit the scope of the invention as more fully set out in the claims attached hereto.

I claim:

1. A method of installing wall to wall carpeting of a selected width over an underpad of a selected thickness, the carpeting having an underside substantially covered with loops, comprising the steps of:

(i) attaching hooked tapes of a thickness substantially equal to the thickness of the underpad along the perimeter of the area to be covered by the carpeting and in which the tapes have a removal covering, (ii) fitting a selected underpad to fill the area bounded by the tapes, (iii) fitting the carpeting as required to the room; and (iv) selectively removing the covering of the tapes to attach the hooks of the tape to the loops on the carpeting.

2. The method of claim 1 in which after step (i), more tape is installed on the floor at locations to correspond to any anticipated seams between abutting carpet pieces and in which the selected underpad is fit within the areas bounded by the tapes.

3. The method of claim 2 in which the underpad has loops substantially covering its lower surface and the underpad is attached to the floor by a second hooked tape having a thickness which is relatively thin in relation to the thickness of the underpad, so that the underpad and second hooked tape are substantially the same thickness as the thickness of the first hooked tape attached to the floor along the perimeter of the underpad.

* * * * *